US009885276B2

(12) United States Patent
Shieh et al.

(10) Patent No.: US 9,885,276 B2
(45) Date of Patent: Feb. 6, 2018

(54) FAN HAVING A TEMPERATURE DETECTING FUNCTION

(71) Applicant: Sunonwealth Electric Machine Industry Co., Ltd., Kaohsiung (TW)

(72) Inventors: Hao-An Shieh, Kaohsiung (TW); Yi-Ling Tu, Kaohsiung (TW)

(73) Assignee: SUNONWEALTH ELECTRIC MACHINE INDUSTRY CO., LTD., Kaohsiung (TW)

( * ) Notice: Subject to any disclaimer, the term of this patent is extended or adjusted under 35 U.S.C. 154(b) by 0 days.

(21) Appl. No.: 14/979,428

(22) Filed: Dec. 27, 2015

(65) Prior Publication Data

US 2016/0201550 A1 Jul. 14, 2016

(30) Foreign Application Priority Data

Jan. 14, 2015 (TW) ..... 104101210 A

(51) Int. Cl.
*F04D 29/52* (2006.01)
*F01P 11/14* (2006.01)
*F04D 25/06* (2006.01)

(52) U.S. Cl.
CPC ..... *F01P 11/14* (2013.01); *F04D 25/0666* (2013.01)

(58) Field of Classification Search
CPC ..... F04D 15/0263; F04D 25/0666; F04D 15/02263
USPC ..... 165/233, 253, 257, 290, 293; 374/208, 374/141, 170, 163, 138, 135; 361/695, 361/678
See application file for complete search history.

(56) References Cited

U.S. PATENT DOCUMENTS

| | | | | |
|---|---|---|---|---|
| 8,251,655 | B2 * | 8/2012 | Chen | F04D 17/16 415/118 |
| 8,648,262 | B2 | 2/2014 | Wu et al. | |
| 2007/0134109 | A1 * | 6/2007 | Peia | H02K 1/145 417/420 |
| 2009/0016879 | A1 | 1/2009 | Chen et al. | |

FOREIGN PATENT DOCUMENTS

| | | | |
|---|---|---|---|
| DE | 202006002789 | U1 | 4/2006 |
| DE | 202004021360 | U1 | 10/2007 |
| KR | 20090016387 | A | 2/2009 |
| TW | I340796 | B | 4/2011 |
| TW | 201229391 | A1 * | 7/2012 |
| TW | 201229391 | A1 | 7/2012 |
| TW | I413462 | B | 10/2013 |

* cited by examiner

*Primary Examiner* — Logan Kraft
*Assistant Examiner* — Sabbir Hasan
(74) *Attorney, Agent, or Firm* — Alan D. Kamrath; Kamrath IP Lawfirm, P.A.

(57) ABSTRACT

A fan having a temperature detecting function includes a fan frame, an extension member, a temperature sensor and a restricting portion. The fan frame has an air inlet, an air outlet, and an impeller rotatably arranged between the air inlet and the air outlet. The extension member has one end adjacent to the fan frame. The temperature sensor is arranged at one of the air inlet and the air outlet via the extension member in a position where the surface of the temperature sensor is fully exposed to the ambient air. The restricting portion is arranged at the one of the air inlet or the air outlet. The restricting portion is located between the extension member and the impeller and is adapted to prevent the extension member from making contact with the impeller.

20 Claims, 8 Drawing Sheets

FAN HAVING A TEMPERATURE DETECTING FUNCTION

CROSS REFERENCE TO RELATED APPLICATIONS

The application claims the benefit of Taiwan application serial No. 104101210, filed on Jan. 14, 2015, and the subject matter of which is incorporated herein by reference.

BACKGROUND OF THE INVENTION

1. Field of the Invention

The present invention generally relates to a fan and, more particularly, to a fan having a temperature sensor for temperature detection.

2. Description of the Related Art

A conventional fan having a temperature sensor is mostly used in a vehicle air-conditioning system. The fan detects the temperature in the vehicle, and the computer of the vehicle controls the operation of the air-conditioning system according to the detected temperature. As such, the temperature in the vehicle can be regulated. FIG. 1 shows a conventional fan 8 with a temperature detecting function. The fan 8 includes a fan frame 81, an impeller 82, a temperature sensor 83 and a lead wire unit 84. The fan frame 81 includes an air inlet 811 and an air outlet 812. The impeller 82 is located between the air inlet 811 and the air outlet 812 and is driven to rotate by a stator. The temperature sensor 83 is fixed at the air inlet 811 by the lead wire unit 84, so that the temperature in the vehicle can be detected. In this arrangement, the temperature sensor 83 is able to detect the temperature in the vehicle, and the detected result is sent to the computer of the vehicle which controls the operation of the air-conditioning system according to the detected result. Such a fan 8 can be seen in Taiwan Patent No. I413462 entitled "A fan and its frame with a supporting structure for a sensor."

Since the lead wire unit 84 is the only component that supports the temperature sensor 83 at the air inlet 811, the temperature sensor 83 cannot be securely fixed at the air inlet 811. Disadvantageously, the vibration generated during the movement of the vehicle may cause shaking of the temperature sensor 83, which further causes the change in position of the temperature sensor 83. When the position of the temperature sensor 83 is changed by the shaking force, the temperature sensor 83 may easily come into contact with the impeller 82 if the temperature sensor 83 is too close to the impeller 82. As a result, the temperature sensor 83 may collide with the impeller 82, resulting in damage to the temperature sensor 83. Thus, the operation of the temperature sensor 83 is affected.

FIG. 2 shows another conventional fan 9 having a temperature detecting function. The fan 9 includes a fan frame 91, an impeller 92, a temperature sensor 93 and a plurality of wire carriers 94. The fan frame 91 also includes an air inlet 911 and an air outlet 912. The impeller 92 is received in the fan frame 91. The temperature sensor 93 is also arranged at the air inlet 911 of the fan frame 91. The plurality of wire carriers 94 extends from the inner periphery of the fan frame 91 and connects to a circular supporting portion 95. The supporting portion 95 is used to support the temperature sensor 93. Such a fan 9 can also be seen in Taiwan Patent No. I413462 entitled "A fan and its frame with a supporting structure for a sensor."

In the fan 9, although the shaking of the temperature sensor 93 is prevented under the support of the wire carriers 94 and the supporting portion 95, the temperature sensor 93 has one face in contact with the support 95. Since the face of the temperature sensor 93 is in abutment with the support 95, ambient air is not able to reach said face, which adversely affects the detecting accuracy and sensitivity of the temperature sensor 93.

In light of the problems of the conventional fans 8 and 9, it is necessary to provide a fan which prevents the collision between the temperature sensor and the impeller while maintaining the detecting accuracy and sensitivity thereof.

SUMMARY OF THE INVENTION

It is therefore the objective of this invention to provide a fan having a temperature detecting function. The fan is capable of preventing the collision between the temperature sensor and the impeller thereof when the position of the temperature sensor is changed by the shaking force, ensuring the detection accuracy and sensitivity of the temperature sensor.

In an embodiment, a fan having a temperature detecting function includes a fan frame, an extension member, a temperature sensor and a restricting portion. The fan frame has an air inlet, an air outlet, and an impeller rotatably arranged between the air inlet and the air outlet. The extension member has one end adjacent to the fan frame. The temperature sensor is arranged at one of the air inlet and the air outlet via the extension member in a position where the surface of the temperature sensor is fully exposed to the ambient air. The restricting portion is arranged at the one of the air inlet and the air outlet. The restricting portion is located between the extension member and the impeller and is adapted to prevent the extension member from making contact with the impeller.

In a form shown, the fan further includes a circuit board coupled with the fan frame. The extension member has one end adjacent to the circuit board and another end adjacent to the temperature sensor. The temperature sensor is electrically connected to the circuit board.

In the form shown, the extension member is in a form of a tube, the temperature sensor is electrically connected to the circuit board via a lead wire, and the lead wire is received in the extension member.

In the form shown, the restricting portion is in a form of a rib located at one of the air inlet and the air outlet and having two ends coupled with a part of an inner periphery of the fan frame. The rib is across the one of the air inlet and the air outlet in order to prevent the extension member from making contact with the impeller.

In another form shown, the restricting portion is in a form of two ribs located at one of the air inlet and the air outlet. Each rib includes a first end coupled with a part of an inner periphery of the fan frame, as well as a second end coupled with the second end of the other rib. The two ribs jointly prevent the extension member from making contact with the impeller.

In the form shown, the fan further includes a lid arranged at the one of the air inlet and the air outlet, and the lid has an opening communicating with the one of the air inlet and the air outlet.

In the form shown, the extension member is in a form of a rod, a tube, a lead wire, a heat shrinkable tubing or a plate.

In the form shown, the restricting portion includes an engaging member adapted to limit the position of the extension member.

In another form shown, the engaging member is in a form of two pieces of opposing engaging panels spaced from each other to form a gap therebetween, and the extension member is received in between the two pieces of opposing engaging panels.

In still another form shown, the engaging member is in the form of a retainer, and the extension member is forced into and retained by the retainer.

In a further form shown, the engaging member is in the form of two walls spaced from each other to form a gap therebetween, and the extension member is received in the gap and positioned between the two walls.

Based on the arrangement of the extension member, ambient air is able to sufficiently reach the entire surface of the temperature sensor. Thus, the detecting accuracy and sensitivity of the temperature sensor are not affected. In addition, the restricting portion is used to support the extension member or limit the position of the extension member, preventing the extension member and the temperature sensor from colliding with the impeller when the positions of the extension member and the temperature sensor are changed by the shaking force. Thus, the detecting sensitivity and accuracy of the temperature sensor are ensured, and normal operation of the air-conditioning system is ensured.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
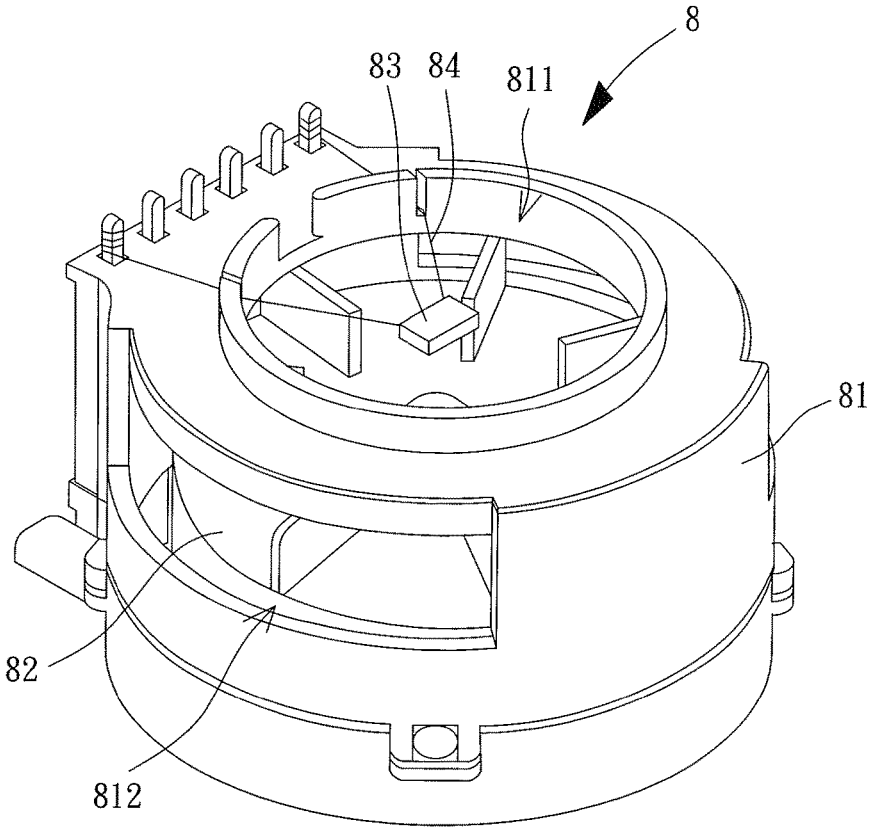
FIG. 1 PRIOR ART
FIG. 1 shows a conventional fan having a temperature detecting function.
Figure 2:
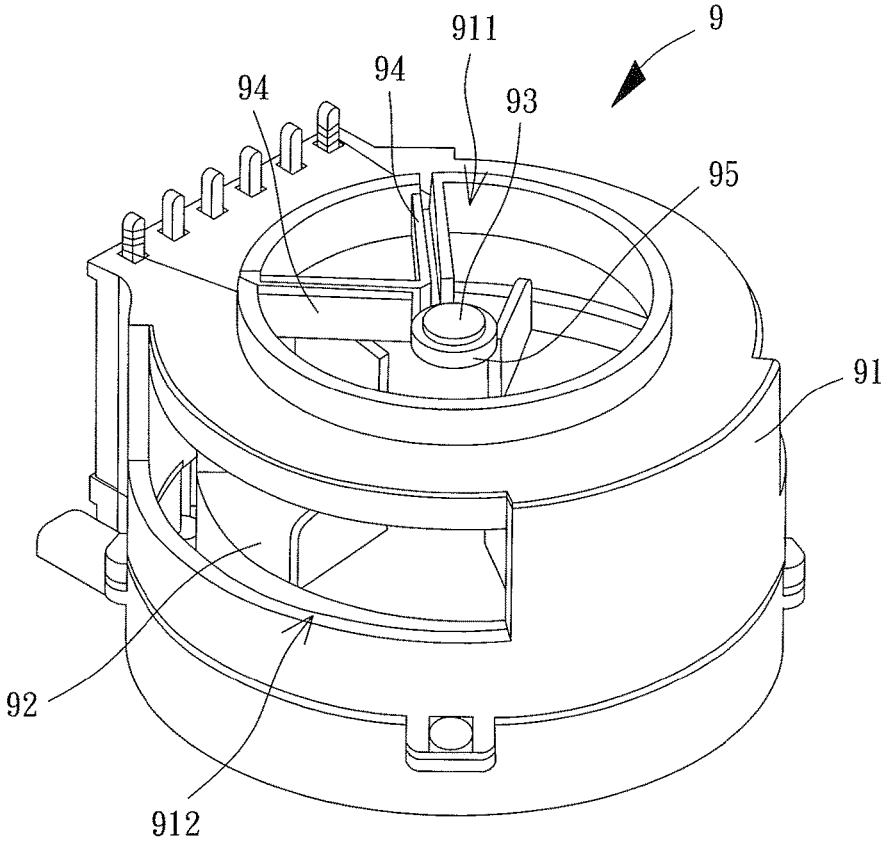
FIG. 2 PRIOR ART
FIG. 2 shows another conventional fan having a temperature detecting function.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 3:
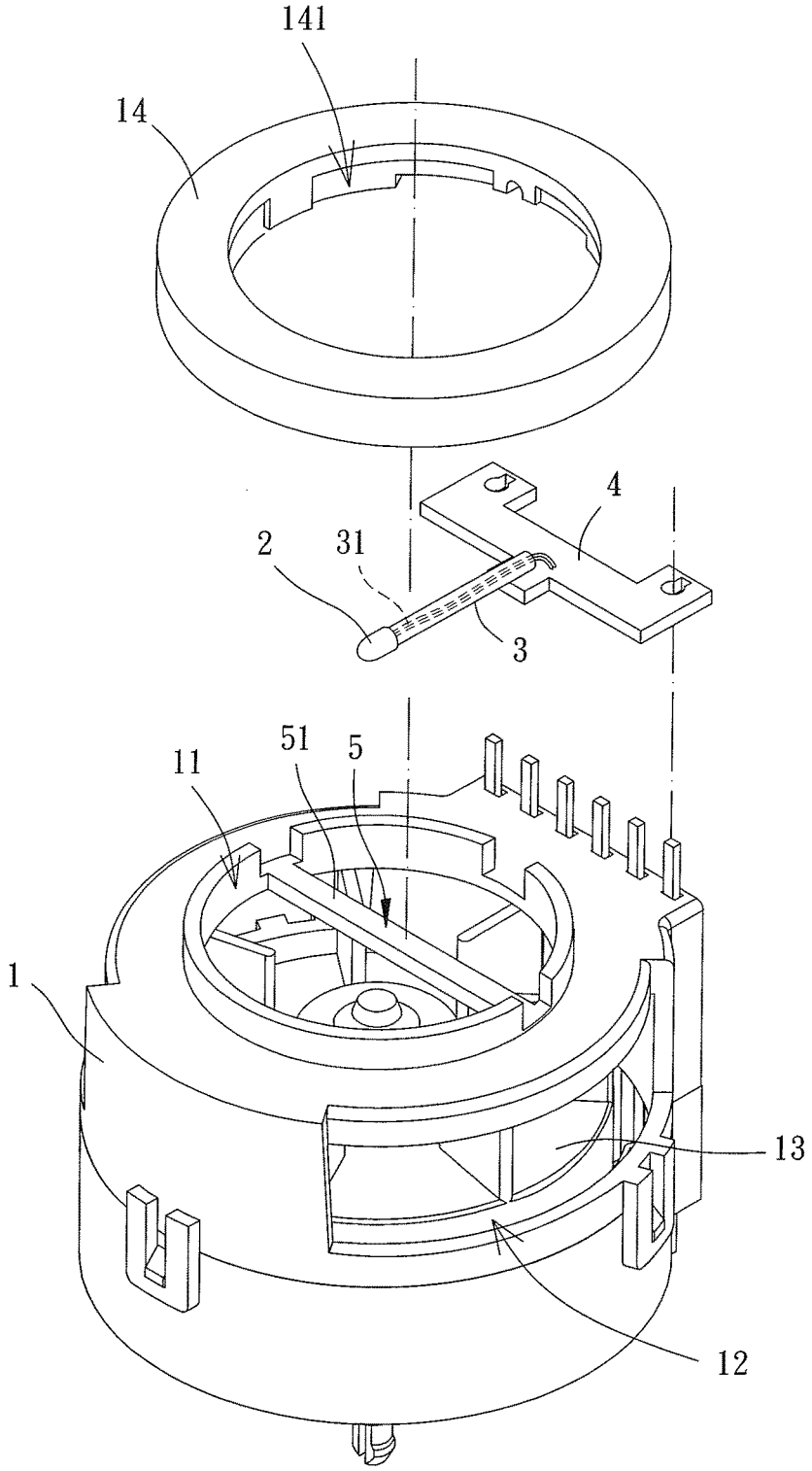
FIG. 3 is an exploded view of a fan having a temperature detecting function according to a first embodiment of the invention.

The fan having a temperature detecting function as discussed below can be used in any air-conditioning system. In the following example, the fan is used in a vehicle air-conditioning system, but is not limited thereto. Referring to FIG. 3, the fan having the temperature detecting function includes a fan frame 1 having an air inlet 11, an air outlet 12 and an impeller 13 arranged between the air inlet 11 and the air outlet 12. The impeller 13 is driven to rotate by a stator. The stator may be of any structure capable of driving the impeller to rotate. For example, the stator may comprise components such as a silicon steel plate, a coil unit, an insulation sleeve or a driving circuit board. The stator is spaced from a permanent magnet by an air gap that is mounted on the inner periphery of the impeller. As such, alternating magnetic fields can be generated via the air gap to drive the impeller. The operation of the fan is not described herein as it can be readily appreciated by skilled persons.

A temperature sensor 2 may be arranged at the air inlet 11 or the air outlet 12. The temperature sensor 2 is fixed at the air inlet 11 or the air outlet 12 via an extension member 3. The extension member 3 may be of any structure capable of supporting the temperature sensor 2 at the air inlet 11 or the air outlet 12, such as a rod, a tube, a lead wire, a heat shrinkable tubing or a plate. The extension member 3 may be fixed to the fan frame 1 directly, or fixed to the fan frame 1 via a circuit board 4. The circuit board 4 is used to receive or transmit the detected result of the temperature 2. Preferably, the circuit board 4 may be integrated on the driving circuit board of the stator. In this embodiment, the temperature sensor 2 is arranged at the air inlet 11 for illustration purposes. The extension member 3 may be in the form of a tube. The extension member 3 includes one end connected to the circuit board 4, as well as another end connected to the temperature sensor 2. The circuit board 4 may be fixed to the fan frame 1 by screwing, fastening, adhesion or welding, in order to improve the coupling strength between the extension member 3, the circuit board 4 and the fan frame 1. The temperature sensor 2 may be electrically connected to the circuit board 4 in a wireless manner or via a lead wire. As shown in FIG. 3, the temperature sensor 2 is electrically connected to the circuit board 4 via a lead wire 31. The lead wire 31 may be received in the extension member 3 for concealment and protection purposes. Alternatively, the lead wire 31 may be used as the extension member 3 without the use of the tube.

A lid 14 may be arranged at the air inlet 11 or the air outlet 12. The lid 14 includes an opening 141. In the embodiment, the lid 14 is arranged at the air inlet 11 for illustration purposes. Specifically, when the temperature sensor 2 is arranged at the air inlet 11, the lid 14 may be arranged at the side of the fan frame 1 where the air inlet 11 is. At this point, the opening 141 of the lid 14 communicates with the air inlet 11. The lid 14 is used to cover and retain the circuit board 4 for concealment and protection purposes. This prevents accumulation of dust on the circuit board 4 and also prevents dampening of the circuit board 4 while providing improved decorative and retaining effects.

A restricting portion 5 is arranged at the air inlet 11 or the air outlet 12 of the fan frame 1. The restricting portion 5 may be integrally formed on the part of the inner periphery of the fan frame 1 adjacent to the air inlet 11 or the air outlet 12. Alternatively, the restricting portion 5 may be attached to or detached from the part of the inner periphery of the fan frame 1 adjacent to the air inlet 11 or the air outlet 12. In this regard, the restricting portion 5 is able to limit the position of the extension member 3 when the extension member 3 is fixed at the air inlet 11 or the air outlet 12. The restricting portion 5 may or may not come into contact with the extension member 3. When the restricting portion 5 is in contact with the extension member 3, the restricting portion 5 may support the extension member 3. To the contrary, the restricting portion 5 is preferably not in contact with the extension member 3 in order not to affect the detecting accuracy and sensitivity of the temperature sensor 2. Based on this, the restricting portion 5 is able to prevent the extension member 3 from colliding with the impeller 13 when the position of the extension member 3 is changed by the shaking force. The restricting portion 5 is simply used to support the extension member 3 or limit the position of the extension member 3 rather than coupling with the temperature sensor 2. Therefore, the temperature sensor 2 will not make contact with the restricting portion 5, ensuring the temperature sensor 2 to be properly fixed at the air inlet 11 or the air outlet 12 such that the temperature sensor 2 can be fully exposed to the ambient air.

Figure 4:
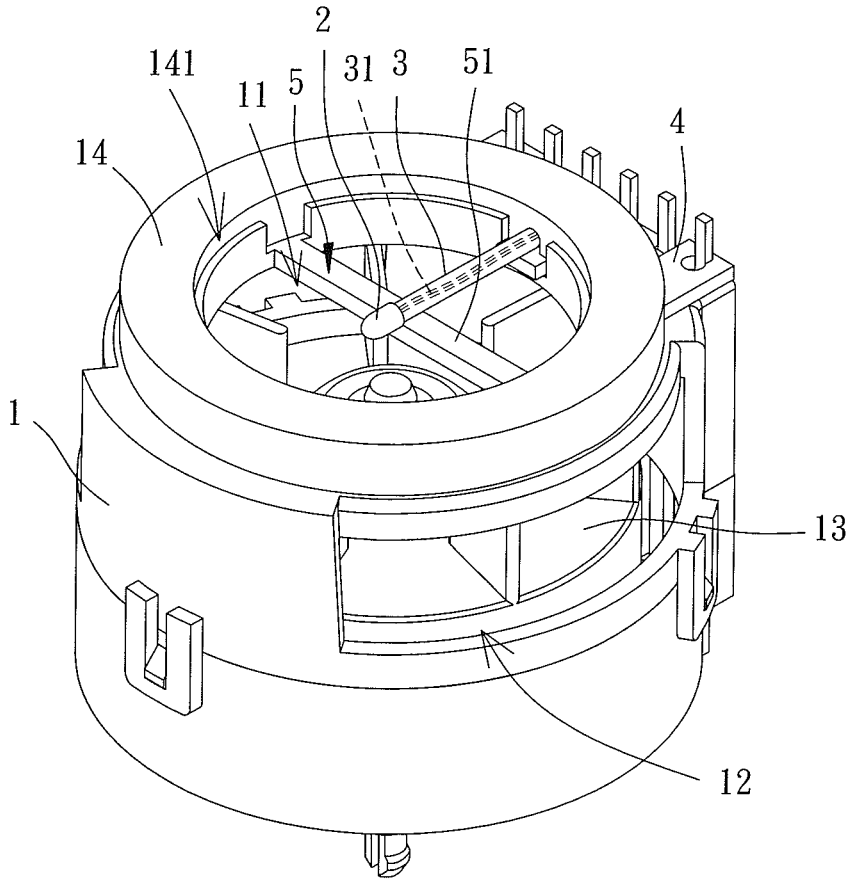
FIG. 4 shows the fan of the first embodiment of the invention.
Figure 5:
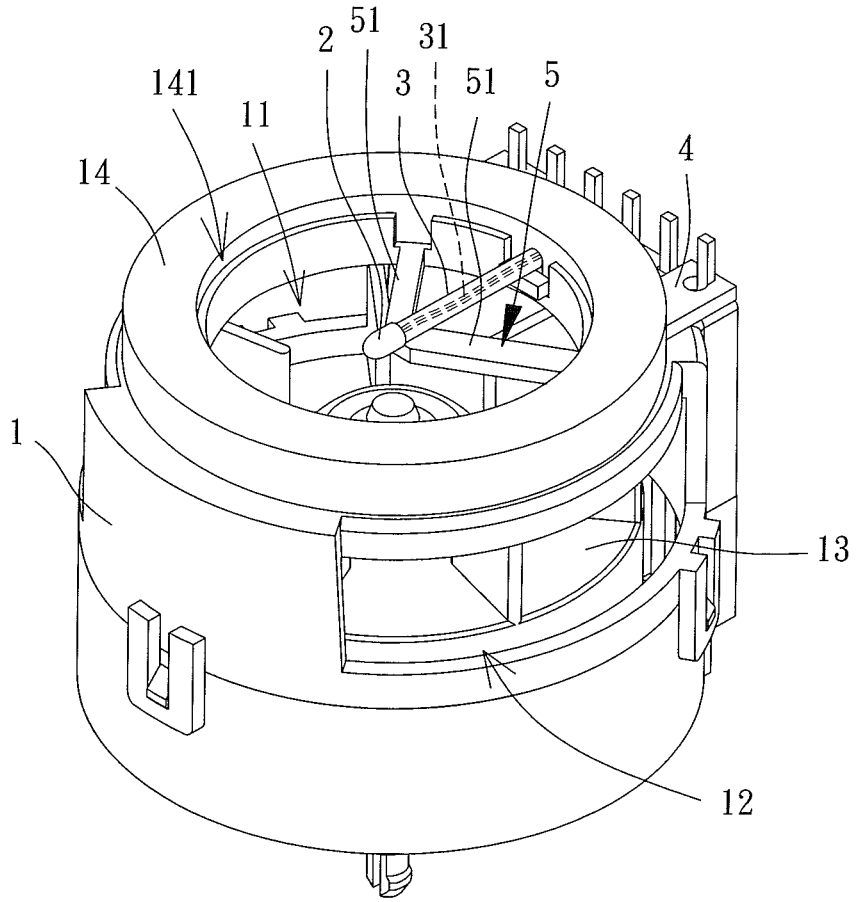
FIG. 5 shows another fan having a temperature detecting function according to a second embodiment of the invention.

Another example is made with the restricting portion 5 integrally formed on the part of the inner periphery of the fan frame 1 adjacent to the air inlet 11. The restricting portion 5 is in the form of a rib 51 as shown in FIG. 4. The rib 51 has two ends coupled with the part of the inner periphery of the fan frame 1 adjacent to the air inlet 11. In this arrangement, the rib 51 appears to be in the form of a bar across the air inlet 11 for supporting the extension member 3 or limiting the position of the extension member 3. Alternatively, the restricting portion 5 is in the form of two ribs 51 as shown in FIG. 5. Each rib 51 includes a first end coupled with the part of the inner periphery of the fan frame 1 adjacent to the air inlet 11, as well as a second end coupled with the second end of the other rib 51. In this arrangement, the two ribs 51 appear to be in a "V" shape and are used to support the extension member 3 or limit the position of the extension member 3. Advantageously, the desired limiting effect and supporting effect of the extension member 3 can be attained.

Figure 6:
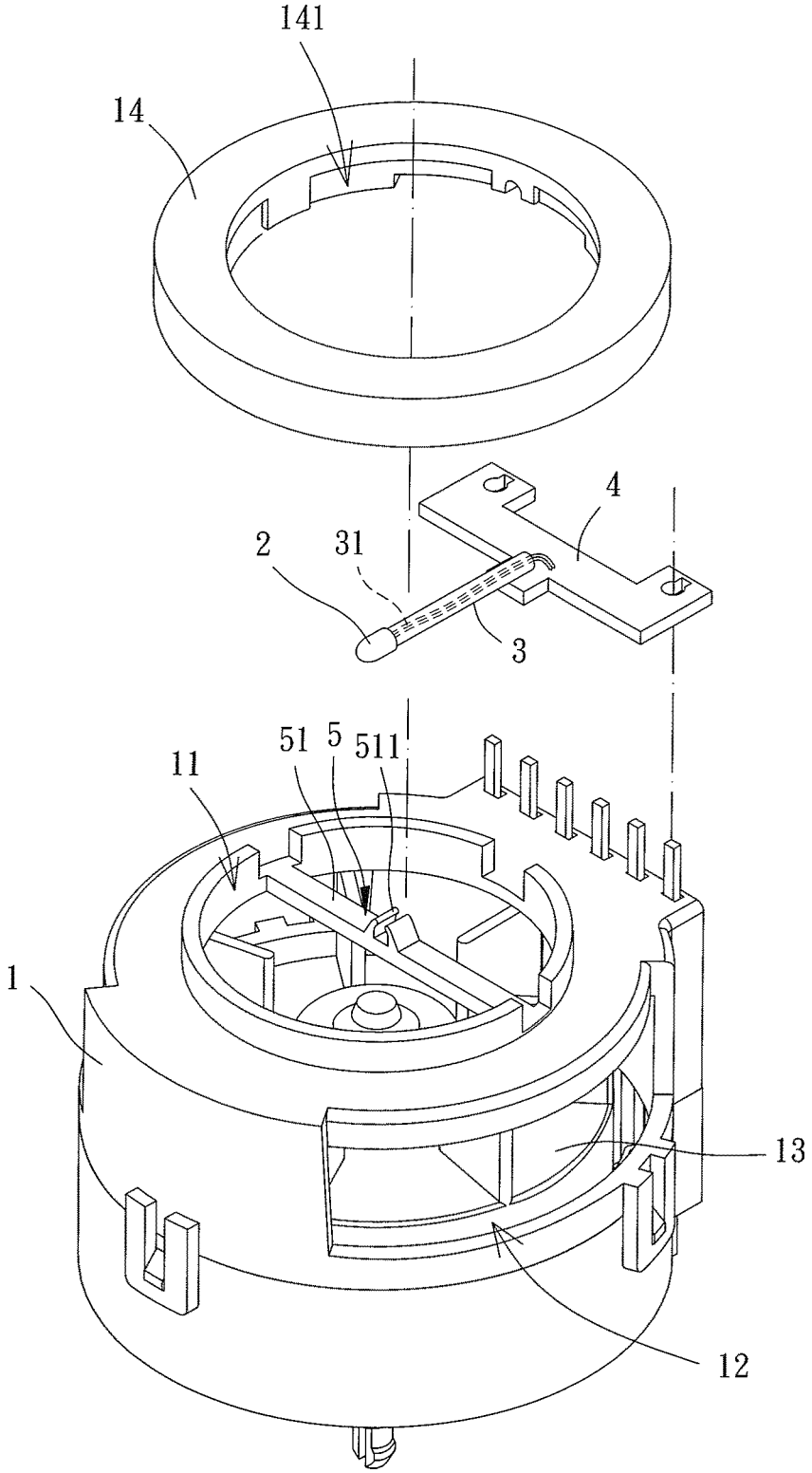
FIG. 6 is an exploded view of the fan of the invention with the engaging member of the fan in the form of two pieces of opposing engaging panels.
Figure 7:
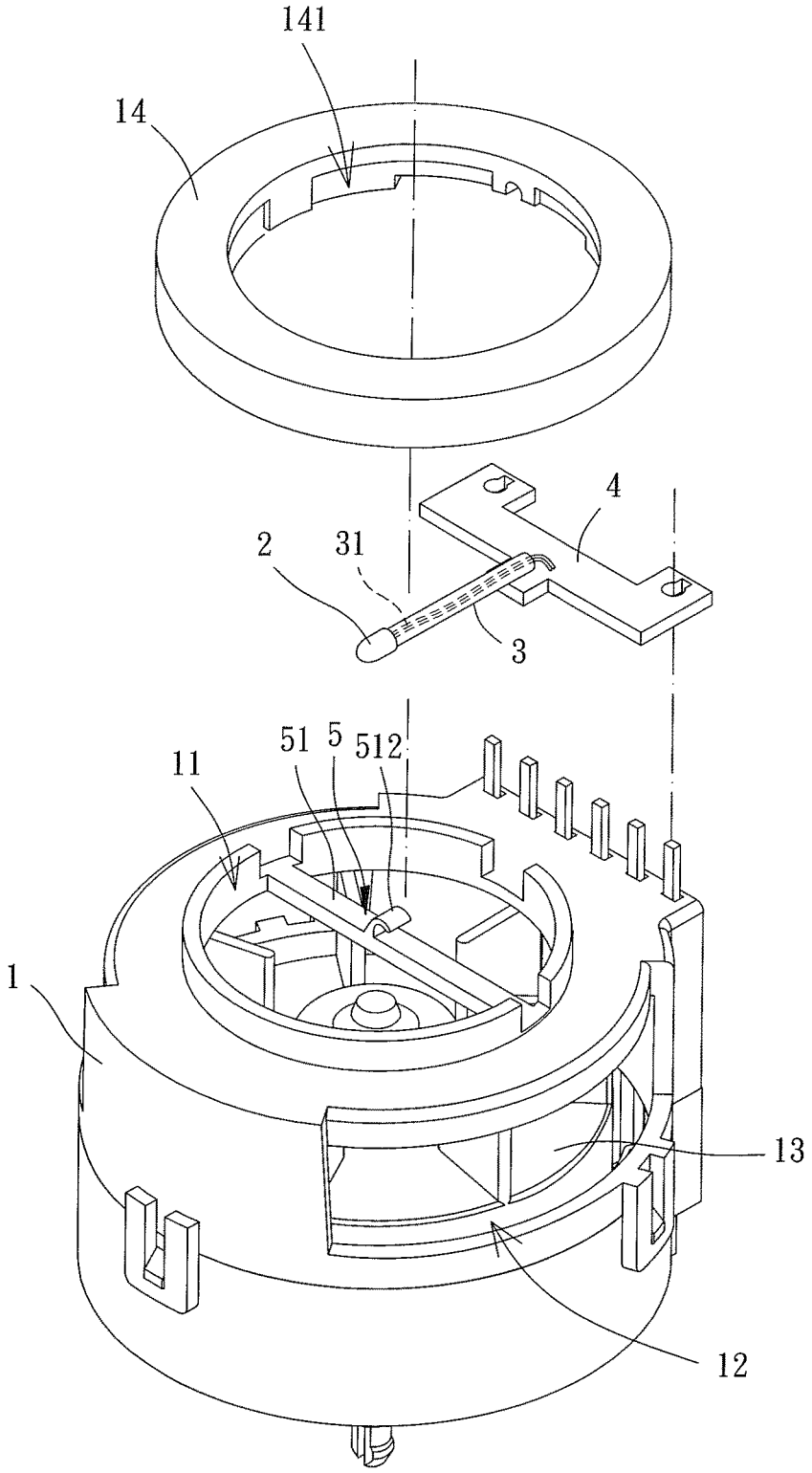
FIG. 7 is an exploded view of the fan of the invention with the engaging member of the fan in the form of a retainer.
Figure 8:
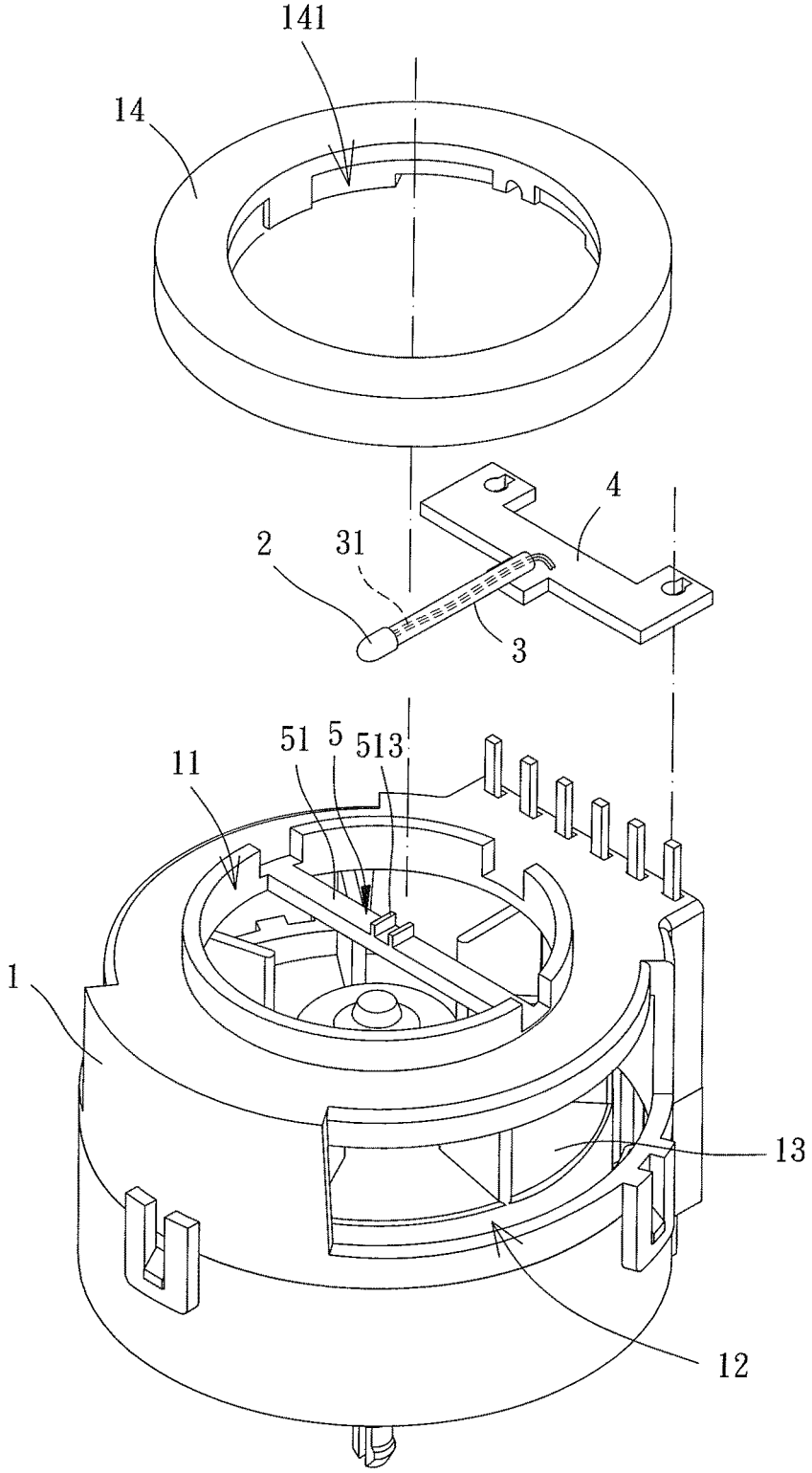
FIG. 8 is an exploded view of the fan of the invention with the engaging member of the fan in the form of two walls spaced from each other.

Moreover, the restricting portion 5 may have an engaging member used to limit the position of the extension member 3. As such, the improved limiting effect of the extension member 3 can be provided. For instance, referring to FIG. 6, the engaging member is in the form of two pieces of opposing engaging panels 511 spaced from each other to form a gap therebetween. The extension member 3 is positioned between the two pieces of engaging panels 511, preventing the extension member 3 from moving leftwards and rightwards in a direction perpendicular to the extending direction of the extension member 3. Referring to FIG. 7, the engaging member is in the form of a retainer 512. The extension member 3 can be forced into and retained by the retainer 512, preventing the extension member 3 from moving up and down in an axial direction of the fan. Referring to FIG. 8, the engaging member is in the form of two walls 513 spaced from each other to form a gap therebetween. The extension member 3 is received in the gap and positioned between the two walls 513, preventing the extension member 3 from moving leftwards and rightwards in the direction perpendicular to the extending direction of the extension member 3.

When the fan having the temperature detecting function of the application is used in a vehicle air-conditioning system, the restricting portion 5 is able to effectively limit the position of the extension member 3. Therefore, the extension member 3 and the temperature sensor 2 will not make contact with the impeller 13 when their positions are changed by the shaking force caused by the movement of the vehicle. Furthermore, since the temperature sensor 2 is fixed at the air inlet 11 or the air outlet 12 via the extension member 3 only, the restricting portion 5 will not make contact with the temperature sensor 2 and will not obstruct the ambient air from reaching the temperature sensor 2. As a result, the temperature sensor 2 can be positioned in a position where the surface of the temperature sensor 2 is fully exposed to the ambient air, ensuring an accurate detection of the temperature sensor 2. In this arrangement, when the circuit board 4 receives the detected result of the temperature sensor 2, the circuit board 4 may transmit the detected result to the computer of the vehicle which regulates the temperature in the vehicle accordingly.

In conclusion, based on the structure of the fan having the temperature detecting function of the application, the temperature sensor 2 can be arranged at one of the air inlet 11 and the air outlet 12 via the extension member 3 in a position where the surface of the temperature sensor 2 is fully exposed to the ambient air. Thus, the detecting accuracy and sensitivity of the temperature sensor 2 are not affected. fan is further designed with the restricting portion 5 that limits the position of the extension member 3, thereby preventing the extension member 3 and the temperature sensor 2 from colliding with the impeller 13 when the positions of the extension member 3 and the temperature sensor 2 are changed by the shaking force. Thus, damage to the extension member 3 and the temperature sensor 2 can be prevented, and the detecting sensitivity and accuracy of the temperature sensor 2 can be ensured.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A fan having a temperature detecting function comprising:

a fan frame having an air inlet, an air outlet, and an impeller rotatably arranged between the air inlet and the air outlet;

an extension member having one end adjacent to the fan frame; and a temperature sensor arranged at one of the air inlet and the air outlet via the extension member, wherein the temperature sensor is connected to another end of the extension member, wherein the temperature sensor is arranged in a position where the entirety of the temperature sensor is fully exposed to ambient air;

a restricting portion arranged at the one of the air inlet and the air outlet, wherein the restricting portion is located between the extension member and the impeller, is located between the end of the extension member and the other end of the extension member, and does not contact the temperature sensor, and wherein the restricting portion is in a path from the extension member to the impeller to prevent the extension member and the temperature sensor from making contact with the impeller.

2. The fan having the temperature detecting function as claimed in claim 1, further comprising a circuit board coupled with the fan frame and located outside of the fan frame, wherein the one end of the extension member is connected to the circuit board, and wherein the temperature sensor is electrically connected to the circuit board.

3. The fan having the temperature detecting function as claimed in claim 2, wherein the extension member is a tube connected to the temperature sensor, wherein the temperature sensor is electrically connected to the circuit board via a lead wire, and wherein the lead wire is received in the tube.

4. The fan having the temperature detecting function as claimed in claim 1, wherein the restricting portion is in a form of a rib having two ends coupled with a part of an inner periphery of the fan frame, wherein the rib is located between the temperature sensor and the impeller along a longitudinal axis, and wherein the rib is across the one of the air inlet and the air outlet to prevent the extension member and the temperature sensor from making contact with the impeller.

5. The fan having the temperature detecting function as claimed in claim 1, wherein the air outlet is spaced from the air inlet along a longitudinal axis, wherein the restricting portion is in a form of two ribs located at the one of the air inlet and the air outlet, wherein each of the two ribs comprises a first end coupled with a part of an inner periphery of the fan frame and a second end, wherein the second ends of the two ribs coupled with each other, wherein the two ribs are located between the temperature sensor and the impeller along the longitudinal axis, wherein the second ends of the two ribs support the extension member, and wherein the two ribs jointly prevent the extension member and the temperature sensor from making contact with the impeller.

6. The fan having the temperature detecting function as claimed in claim 1, wherein the air outlet is spaced from the air inlet along a longitudinal axis, wherein the restricting portion comprises a surface facing away from the impeller along the longitudinal axis, wherein an engaging member is formed on the surface of the restricting portion, and wherein the engaging member holds the extension member.

7. The fan having the temperature detecting function as claimed in claim 6, wherein the engaging member is in a form of two pieces of opposing engaging panels having a gap therebetween, wherein the two pieces of engaging panels and the gap are located between the temperature sensor and an inner periphery of the fan frame delimiting the one of the air inlet and the air outlet in a radial direction perpendicular to the longitudinal axis, wherein the restricting portion extends perpendicularly to the extension member, and wherein the extension member is received in between the two pieces of opposing engaging panels.

8. The fan having the temperature detecting function as claimed in claim 6, wherein the engaging member is in the form of a retainer, wherein the retainer is located between the temperature sensor and an inner periphery of the fan frame delimiting the one of the air inlet and the air outlet in a radial direction perpendicular to the longitudinal axis, wherein the restricting portion extends perpendicularly to the extension member, and wherein the extension member is forced into and retained by the retainer.

9. The fan having the temperature detecting function as claimed in claim 6, wherein the engaging member is in the form of two walls having a gap therebetween, wherein the two walls and the gap are located between the temperature sensor and the an inner periphery of the fan frame delimiting the one of the air inlet and the air outlet in a radial direction perpendicular to the longitudinal axis, wherein the restricting portion extends perpendicularly to the extension member, and wherein the extension member is received in the gap and positioned between the two walls.

10. The fan having the temperature detecting function as claimed in claim 1, wherein the air inlet is spaced from the air outlet along a longitudinal axis, wherein the temperature sensor includes a first end connected to the other end of the extension member and a second end spaced from the first end in a radial direction perpendicular to the longitudinal axis, wherein the surface is a peripheral surface extending between the first end and the second end of the temperature sensor, and wherein the peripheral surface of the temperature sensor is fully exposed to the ambient air in the one of the air inlet and the air outlet.

11. The fan having the temperature detecting function as claimed in claim 1, wherein the restricting portion extends from a first point of the one of the air inlet and the air outlet to a second point of the one of the air inlet and the air outlet, with the second point being circumferentially separated from the first point, with the restriction portion located intermediate the temperature sensor and the one end of the extension member, with the one end of the extension member being circumferentially separated from the first and second points.

12. The fan having the temperature detecting function as claimed in claim 11, wherein the extension member abuts the restricting portion intermediate the temperature sensor and the one end of the extension member.

13. A fan having a temperature detecting function comprising:

a fan frame having an air inlet, an air outlet, and an impeller rotatably arranged between the air inlet and the air outlets;

an extension member having one end adjacent to the fan frame;

a temperature sensor arranged at one of the air inlet and the air outlet via the extension member, wherein the temperature sensor is connected to another end of the extension member, wherein the temperature sensor is arranged in a position where a surface of the temperature sensor is fully exposed to ambient air;

a restricting portion arranged at the one of the air inlet and the air outlet, wherein the restricting portion is located between the extension member and the impeller, is located between the end of the extension member and the other end of the extension member, and is spaced from the temperature sensor, and wherein the restricting portion is in a path from the extension member to the impeller to prevent the extension member and the temperature sensor from making contact with the impeller;

a circuit board coupled with the fan frame and located outside of the fan frame, wherein the one end of the extension member is connected to the circuit board, and wherein the temperature sensor is electrically connected to the circuit board; and a lid arranged at the one of the air inlet and the air outlet, wherein the lid has an opening communicating with the one of the air inlet and the air outlet, wherein the circuit board is located outside of the lid, and wherein the extension member extends through the lid.

14. The fan having the temperature detecting function as claimed in claim 13, wherein the extension member is in a form of a rod, a tube, a lead wire, a heat shrinkable tubing or a plate.

15. The fan having the temperature detecting function as claimed in claim 13, wherein the restricting portion extends at a non-parallel angle to the extension member.

16. The fan having the temperature detecting function as claimed in claim 13, wherein the restricting portion is in a form of a rib having two ends coupled with a part of an inner periphery of the fan frame, wherein the rib is located between the temperature sensor and the impeller, and wherein the rib is across the one of the air inlet and the air outlet to prevent the extension member and the temperature sensor from making contact with the impeller.

17. The fan having the temperature detecting function as claimed in claim 16, wherein the rib extends perpendicularly to the extension member.

18. The fan having the temperature detecting function as claimed in claim 13, wherein the restricting portion is in a form of two ribs located at the one of the air inlet and the air outlet, wherein each of the two ribs comprises a first end coupled with a part of an inner periphery of the fan frame and a second end, wherein the second ends of the two ribs coupled with each other, wherein the two ribs are located between the temperature sensor and the impeller, wherein the second ends of the two ribs support the extension member, and wherein the two ribs jointly prevent the extension member and the temperature sensor from making contact with the impeller.

19. The fan having the temperature detecting function as claimed in claim 18, wherein the extension member extends at an acute angle to each of the two ribs.

20. The fan having the temperature detecting function as claimed in claim 13, wherein the restricting portion comprises a surface facing away from the impeller, wherein an engaging member is formed on the surface of the restricting portion, and wherein the engaging member holds the extension member.

* * * * *